US009677861B2

(12) United States Patent
Ames

(10) Patent No.: US 9,677,861 B2
(45) Date of Patent: Jun. 13, 2017

(54) FLECHETTE WEAPON SYSTEM AND METHOD EMPLOYING MINIMAL ENERGETIC MATERIAL

(71) Applicant: Raytheon Company, Waltham, MA (US)

(72) Inventor: Richard Ames, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/701,099

(22) Filed: Apr. 30, 2015

(65) Prior Publication Data

US 2016/0320166 A1 Nov. 3, 2016

(51) Int. Cl.
*F42B 10/64* (2006.01)
*F42B 12/60* (2006.01)

(52) U.S. Cl.
CPC ..... *F42B 10/64* (2013.01); *F42B 12/60* (2013.01)

(58) Field of Classification Search
CPC .. F42B 5/03; F42B 10/02; F42B 10/04; F42B 10/06; F42B 10/12; F42B 10/14; F42B 10/60; F42B 10/62; F42B 10/64; F42B 12/362; F42B 14/065; F42B 15/01; F42B 15/36; F42B 15/38; F42B 12/60; F42B 15/38
USPC ..... 102/389, 438, 491, 494, 506, 703
See application file for complete search history.

(56) References Cited

U.S. PATENT DOCUMENTS

| | | | | |
|---|---|---|---|---|
| 4,072,107 | A * | 2/1978 | Saxe | F42B 12/58 102/388 |
| 4,586,680 | A * | 5/1986 | DiTommaso | F42B 10/146 244/3.24 |
| 5,535,679 | A * | 7/1996 | Craddock | F42B 12/32 102/389 |
| 5,969,287 | A * | 10/1999 | Blain | F42B 15/38 102/275.5 |
| 7,261,040 | B2 | 8/2007 | Hunn et al. | |
| 8,661,980 | B1 | 3/2014 | Roemerman et al. | |
| 2003/0019386 | A1* | 1/2003 | Lloyd | F41H 11/02 102/494 |
| 2005/0066840 | A1* | 3/2005 | Michel | F42B 12/62 102/393 |
| 2008/0000380 | A1* | 1/2008 | Dryer | F41B 6/00 102/520 |
| 2008/0307994 | A1* | 12/2008 | Gustafsson | F41H 11/02 102/489 |

(Continued)

*Primary Examiner* — Bret Hayes
(74) *Attorney, Agent, or Firm* — Renner, Otto, Boisselle & Sklar, LLP

(57) ABSTRACT

A projectile having a leading section and a trailing section coupled together to define a structure for delivering a plurality of flechettes. The trailing section includes aerodynamic control surfaces that are deployable to apply an aerodynamic braking force to the trailing section to separate the trailing section from the leading section. The flechettes surround an explosive charge in the leading section such that initiation of the explosive charge outwardly disperses the flechettes after the leading section and the trailing section have separated. The control surfaces optionally also may impart spin to the projectile to assist in dispersing the flechettes. Thus, aerodynamic force is employed to assist in removing the flechettes from their confining structure in the projectile before dispersing them.

19 Claims, 4 Drawing Sheets

(56) References Cited

U.S. PATENT DOCUMENTS

| | | | | |
|---|---|---|---|---|
| 2010/0219285 | A1* | 9/2010 | Facciano | F42B 10/64<br>244/3.25 |
| 2011/0083418 | A1* | 4/2011 | Ciezki | F02K 9/90<br>60/230 |

* cited by examiner

FLECHETTE WEAPON SYSTEM AND METHOD EMPLOYING MINIMAL ENERGETIC MATERIAL

FIELD OF THE INVENTION

The present invention is related to a weapons system that delivers pre-shaped shrapnel, called flechettes, onto a target. More particularly, the present invention is related to a weapons system and method for dispensing flechettes.

BACKGROUND

"Fléchette" is a French word for dart, and flechette shells typically contain thousands of pre-shaped, dart-like objects, referred to as flechettes, that typically are dispensed at high velocities and in large numbers to damage various types of targets. Flechette shells, generally in the form of a bomb, rocket, missile, or other projectile, are designed to dispense and disperse large numbers of flechettes above a target to rain down on a target area. Flechettes typically are not powered and rely on kinetic energy to damage the target.

Flechettes can be dispensed from a projectile in forward, aft, or radially outward directions. Most previous flechette dispensing mechanisms use a combination of large amounts of highly energetic material, typically an explosive material, and/or frangible body structures to maintain flechette energy. For many projectiles, however, frangible structures are not an option due to mechanical load requirements. Launching a flechette shell from a gun, for example, can impose very high structural or mechanical loads on the structure of the shell.

SUMMARY

The invention described here uses aerodynamic force to assist in removing the flechettes from a confining structure of a projectile before dispersing them. In this manner, because energy is extracted from the fluid flow passing the projectile the amount of energetic material required is significantly reduced. A small amount of energetic material, such as a small cutting explosive charge, or other means may be used to release an outer portion of the projectile body in such a way that aerodynamic forces expose the flechettes, and a small burster explosive charge or other means is used to disperse the flechettes once they are removed from the outer projectile body. Using this approach, low-energy energetic materials can be used and efficiently employed so that only small amounts are necessary.

More particularly, and summarizing the claims, the present invention provides a projectile having a leading section and a trailing section coupled together. The trailing section includes aerodynamic control surfaces that are deployable to apply an aerodynamic braking force to the trailing section to separate the trailing section from the leading section. The leading section has a plurality of flechettes surrounding an explosive charge to outwardly disperse the flechettes The projectile may include a coupling that holds the leading section and the trailing section together.

The projectile may include a decoupler adapted to release the leading section from the trailing section, in which case the explosive charge mentioned above may be a second explosive charge and the decoupler may include a first explosive charge. The first explosive charge may include one of a shaped charge and a ring cutting charge.

The second explosive charge may be a longitudinally-extending pyro burster explosive charge. Additionally or alternatively, the second explosive charge may extend parallel to a longitudinal axis of the projectile and may taper toward a leading end.

The control surfaces may include control fins having a controllable attitude to control the flight of the projectile. The control surfaces may include a control fin that is rotatable to a braking orientation. The control surfaces may extend perpendicular to the outer surface of the trailing section, and the control surfaces may include a plurality of control surfaces circumferentially arranged around the trailing section.

The flechettes may be circumferentially arrayed around and parallel to a longitudinal axis of the projectile.

The projectile also may include a controller adapted to control the control surfaces.

The projectile may include a first, shaped explosive charge arranged to break a coupling between the leading section and the trailing section, and a second, central longitudinally-extending dispersing explosive charge around which the flechettes are arrayed, and the controller may be configured to initiate the shaped explosive charge to uncouple the leading section from the trailing section, to control the attitude of the control surfaces to the braking attitude to retard forward motion of the trailing section and thereby use aerodynamic forces to separate the leading section from the trailing section, and then to initiate the dispersing explosive charge to outwardly disperse the flechettes.

The projectile may have a casing formed by the leading section and the trailing section, with the leading section being telescopically received in the trailing section.

The present invention also provides a method of deploying a flechette weapon system having a leading section and a trailing section. The method includes the following steps: (a) uncoupling the leading section from the trailing section, (b) separating the leading section from the trailing section after the uncoupling step; and (c) dispersing multiple flechettes from the leading section radially outwardly after the separating step.

The separating step may include deploying control surfaces to apply an aerodynamic braking force to the trailing section.

The dispersing step may occur after a predetermined delay following the separating step to allow complete separation of the leading section from the trailing section before dispersing the flechettes. The dispersing step optionally may include spinning the leading section to help outwardly disperse the flechettes.

The present invention further provides a projectile that includes a housing having a leading section at a leading end telescopically extending into a trailing section at a trailing end, with the leading section and the trailing section being held together by a coupling. The projectile further includes a first explosive charge that includes a shaped explosive ring-cutting charge arranged to break the coupling upon initiation, thereby decoupling the leading section from the trailing section. The leading section has a plurality of flechettes surrounding a second explosive charge that includes a central longitudinally-extending pyro-burster explosive charge. The second explosive charge tapers toward the leading end of the housing. The projectile further includes a plurality of aerodynamic control fins extending from an outer surface of the housing that are movable to a braking attitude that causes an aerodynamic braking force to be applied to the trailing section during flight. And finally, the projectile includes a controller that (a) initiates the first explosive charge to release the trailing section from the leading section, (b) controls the movement of the control fins to the braking attitude to separate the trailing section from the leading section, and (c) initiates the second explosive charge to disperse the flechettes from the leading section after a predetermined delay to allow the leading section to separate from the trailing section.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

Figure 1:
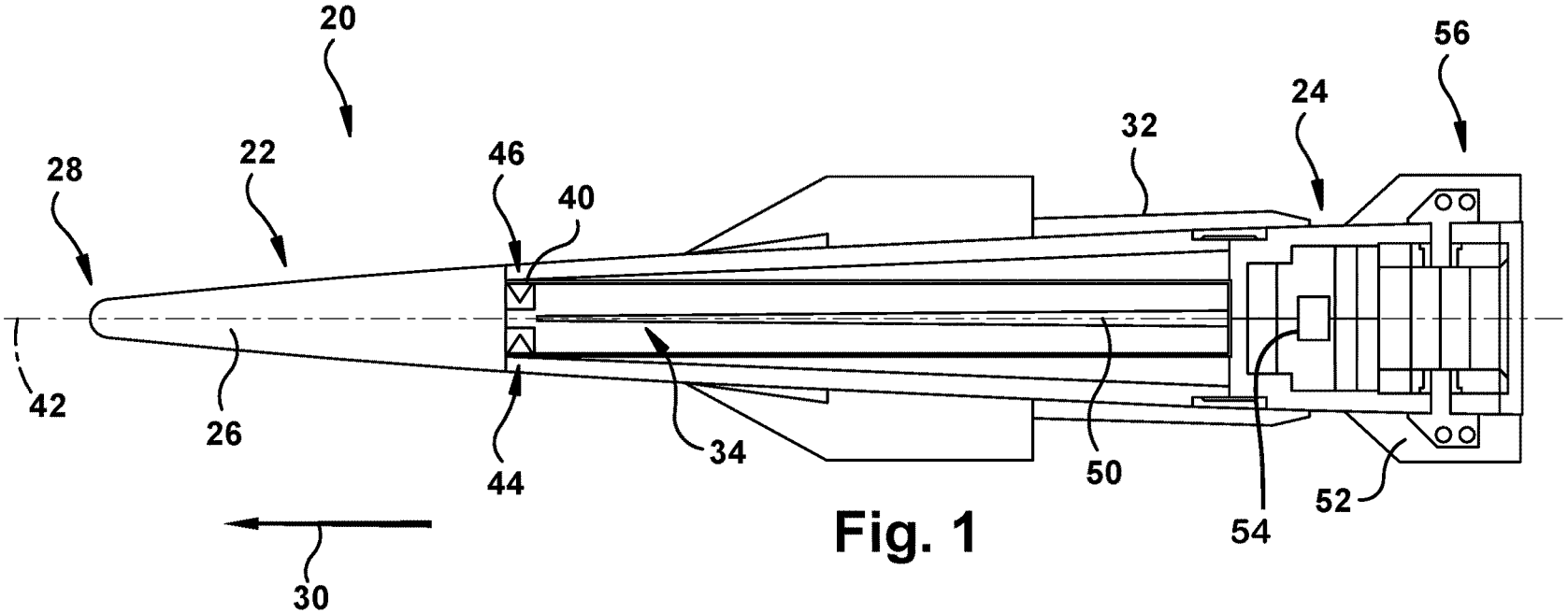
FIG. 1 is a schematic illustration, partially in section, of a projectile provided in accordance with the present invention.

The present invention provides a flechette weapon system and method that uses aerodynamic force to assist in removing the flechettes from a confining structure before dispersing them. By using energy from fluid flow passing the projectile during flight, the invention minimizes the amount of energetic material required. More particularly, aerodynamic control surfaces deployed from the projectile are used to extract energy from relative movement of the projectile during flight to help release an outer portion of the projectile body to expose the flechettes. A small burster charge is used to disperse the flechettes once they are removed from the outer projectile body. Using this approach, low-energy or small amounts of energetic materials, such as explosive materials, can be used and efficiently employed to minimize the necessary quantity and volume requirements for energetic materials.

Projectiles that dispense flechettes forward or aft lose significant amounts of energy to the flechettes because of either the need to move other materials along with the flechettes or as a result of dispensing the flechettes in a direction opposite the projectile's direction of motion. Likewise, dispensing flechettes along radial axes typically requires energy to fracture the body containing the flechettes, thereby again reducing the energy available to the flechettes. An ideal flechette dispersal mechanism avoids these energy losses so that the flechettes maintain the maximum possible kinetic energy.

Flechette-dispensing weapon systems often use relatively thin outer walls with small amounts of energetic material because otherwise the small amount of energetic material generally would be insufficient to open the projectile to disperse the flechettes. But thin-walled designs sometimes cannot meet launch load requirements, which generally are higher for gun-launched projectiles, for example.

When thick walls have been necessary to meet the launch load requirements, or for other reasons, previous designs used large amounts of energetic materials to open the structure and disperse the flechettes. By their nature, larger amounts of energetic materials present greater safety risks for handling and storage, and the risk increases the greater the quantity of energetic material that is present.

For high speed projectiles, there is no need to add energy to the flechettes if they can be dispensed in an efficient manner. In these instances, the addition of energetic materials displaces mass and volume that could be used for a larger number of flechettes. Additionally, very high speeds generate friction with the air or other fluid medium and consequently a lot of heat in the projectile. Thus higher speeds may limit the amount of energetic material that can be used without premature initiation due to elevated temperatures within the projectile. Smaller hypersonic projectiles, for example, allow little room for thermal insulation.

Accordingly, our invention provides a way to dispense flechettes from a high-speed weapon platform with minimal energetic material while maximizing the volume of space for the flechettes.

Turning now to the drawings specifically, FIG. 1 illustrates an exemplary projectile 20 provided by the invention. The projectile 20 is a vehicle capable of flight, and may include a bomb, a shell, a missile, a rocket, or other projectile. Flight of the projectile 20 can be achieved via a gun launch; free fall from altitude, such as after being dropped from an airplane; and rocket or other powered flight, whether controlled or ballistic. The projectile's flight typically will be through air, but potentially through water, or other fluid medium.

The structure of the projectile 20 may be sufficiently robust for any method of launch and flight, while minimizing the amount of energetic material required to open the outer projectile body to release flechettes. To that end, the illustrated projectile 20 has a forward or leading section 22 and an aft or trailing section 24 coupled together to form a structure that may be referred to as a housing or a casing. In the illustrated embodiment, the leading section 22 includes a nose 26 at a leading end 28 of the projectile 20 that tapers in the leading or forward direction 30. The remainder of the leading section 22 is telescopically received in the trailing section 24, which cooperates with the nose 26 of the leading section 22 to define the outer projectile body or outer surface 32 of the casing.

Figure 2:
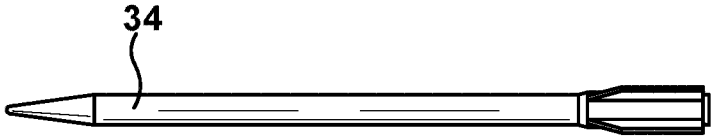
FIG. 2 is a schematic illustration of a flechette from the projectile of FIG. 1.

The projectile 20 contains a plurality, and potentially hundreds or thousands, of flechettes 34, such as that shown in FIG. 2, in the leading section 22 of the projectile. The flechettes 34 are held in the leading section 22 through any means, such as a shell, mesh, or sheath made of plastic or metal, and because the casing of the projectile provides the structural strength, the shell or other means for holding the flechettes 34 in place can be very thin and light. Its purpose is just to hold the flechettes 34 in place until the trailing section 24 is removed. The illustrated flechette 34 has a dart-like shape, but the present invention is not limited to any particular shape flechette, which may include any type of pre-formed shrapnel.

The projectile 20 also includes a first explosive charge 40 to separate the leading section 22 from the trailing section 24 and a second explosive charge 50 to outwardly disperse the flechettes 34. The flechettes 34 surround the second explosive charge 50, which is configured to outwardly disperse the flechettes 34 from the leading section 22 of the projectile 20 after the outer, trailing section 24 of the projectile 20 is removed. The flechettes 34 typically are circumferentially arrayed around and parallel to a longitudinal axis 42 of the projectile.

The second explosive charge 50 extends longitudinally, parallel to or aligned with the longitudinal axis 42 of the projectile 20, substantially the entire length of the flechette-carrying space in the leading section 22. An exemplary second explosive charge 50 is a pyro burster explosive charge that tapers toward a leading end 28 of the leading section 22 of the projectile 20. Alternatively, the second explosive charge 50 may taper toward a trailing end of the leading section 22 or have a uniform cross-section along its entire length or a different variation in its cross-section along its length.

The projectile 20 may include a coupling 44 that holds the leading section 22 and the trailing section 24 together. The coupling 44 may be a discrete component or may be incorporated into the leading section 22, the trailing section 24, or a combination of the two. Any method for connecting the leading section 22 and the trailing section 24 together may be used. The coupling 44 may be formed of a portion of the trailing section 24 and a welded connection to the leading section 22, for example. Other connections may include bolts, screws, adhesives, snap connections, etc. The invention is not limited by the method of connecting the leading section 22 to the trailing section 24.

The projectile 20 may further include a decoupler 46 adapted to release the leading section 22 from the trailing section 24. The decoupler 46 may include the first explosive charge 40. The first explosive charge 40 may include one of a shaped charge and a ring cutting charge that can break the coupling or other connection holding the leading section 22 and the trailing section 24 together upon initiation. The first explosive charge 40 may operate by cutting, burning, bursting, chemically dissolving or weakening, or otherwise reacting to an initiation signal to uncouple the leading section 22 from the trailing section 24.

The trailing section 24 also includes aerodynamic control surfaces 52 that are deployable to apply an aerodynamic braking force to the trailing section 24 to help separate the trailing section 24 from the leading section 22.

The control surfaces 52 include a plurality of movable control surfaces circumferentially arranged around the circumference of the trailing section 24. The control surfaces 52 may include control fins that extend perpendicular to the outer surface 32 of the trailing section 24, as shown in the illustrated embodiment. The control surfaces 52 may have a controllable attitude to control the flight of the projectile 20, including the ability to apply a braking force to the trailing section 24 of the projectile 20 when in a braking attitude during flight. The control surfaces 52 optionally also may have the ability to generate spin about the longitudinal axis 42 or other axis to assist in outwardly dispersing the flechettes 34. Spinning the projectile 20 may assist in increasing the distance over which the flechettes 34 are dispersed from the projectile 20 and may permit further reduction in the size of the second, dispersal explosive charge 50. The control fin 52 may be rotatable, for example, from one or more guidance positions to a braking orientation and optionally a spin orientation.

The projectile 20 also may include a controller 54 adapted to control (a) the control surfaces 52 during flight, including to the braking attitude and optionally the spin attitude; (b) the decoupler 46, such as a ring-cutting first explosive charge 40; and (c) the flechette-dispersing second explosive charge 50. The controller 54 typically includes a processor, a memory, an electrical power source (such as a battery) (not shown), and electrical connections to the control surfaces 52 and the first and second explosive charges 40 and 50. The controller 54 and first and second explosive charges 40 and 50 also may have associated igniters and pyrotechnic delayed reactions associated therewith.

Figure 3:
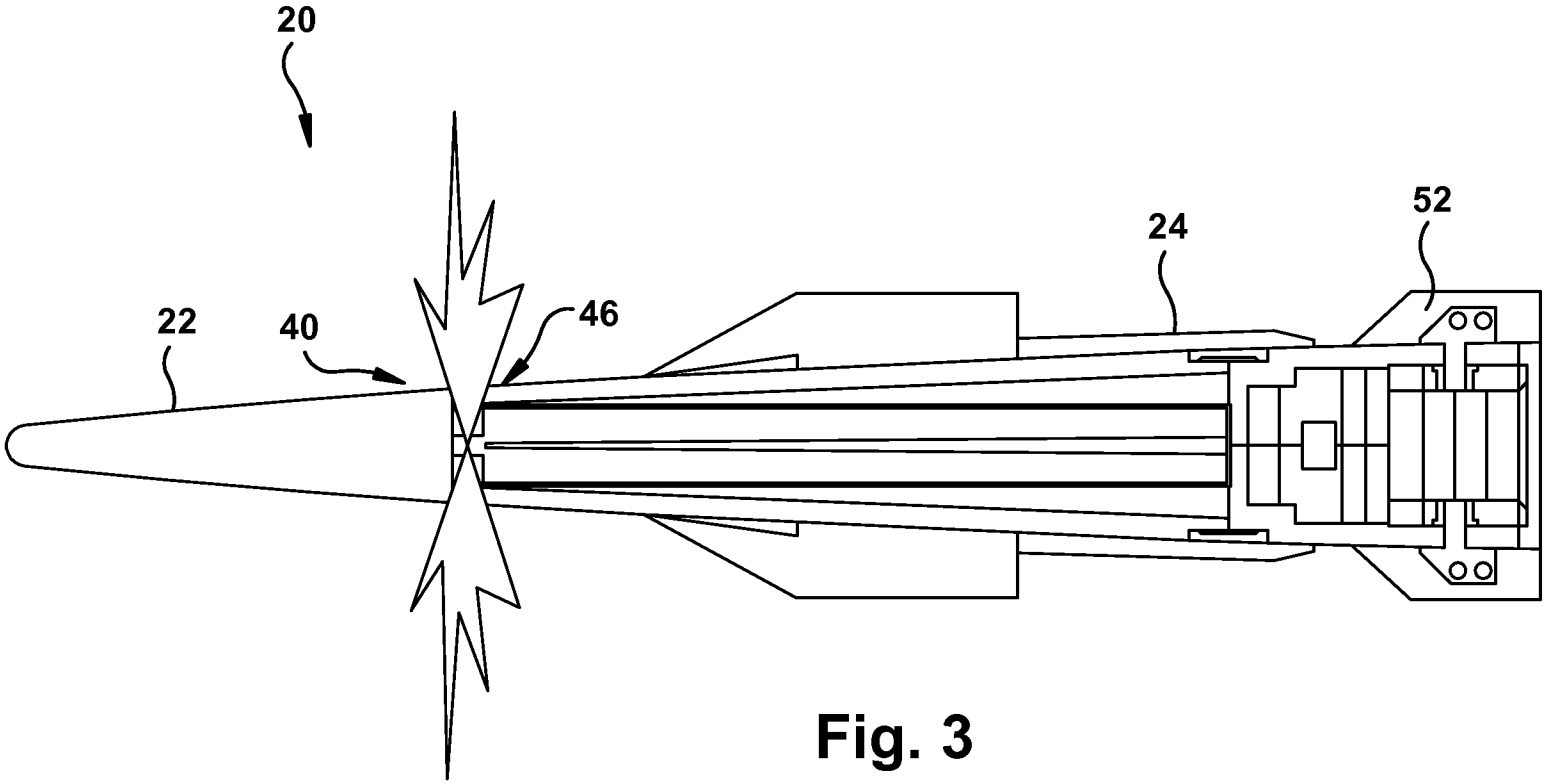
FIGS. 3 to 5 are sequential schematic illustrations of a projectile provided by the invention, that illustrate a method of dispersing flechettes provided by the invention.
Figure 4:
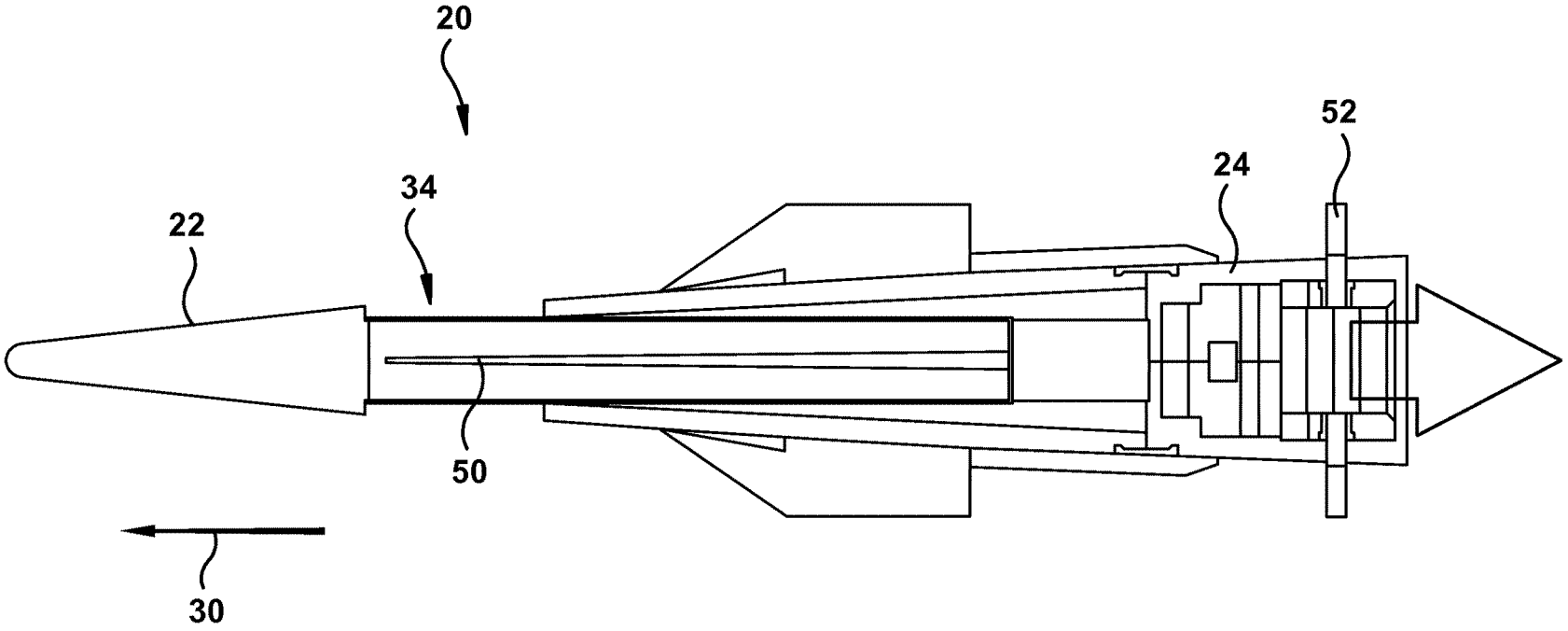
Figure 5:
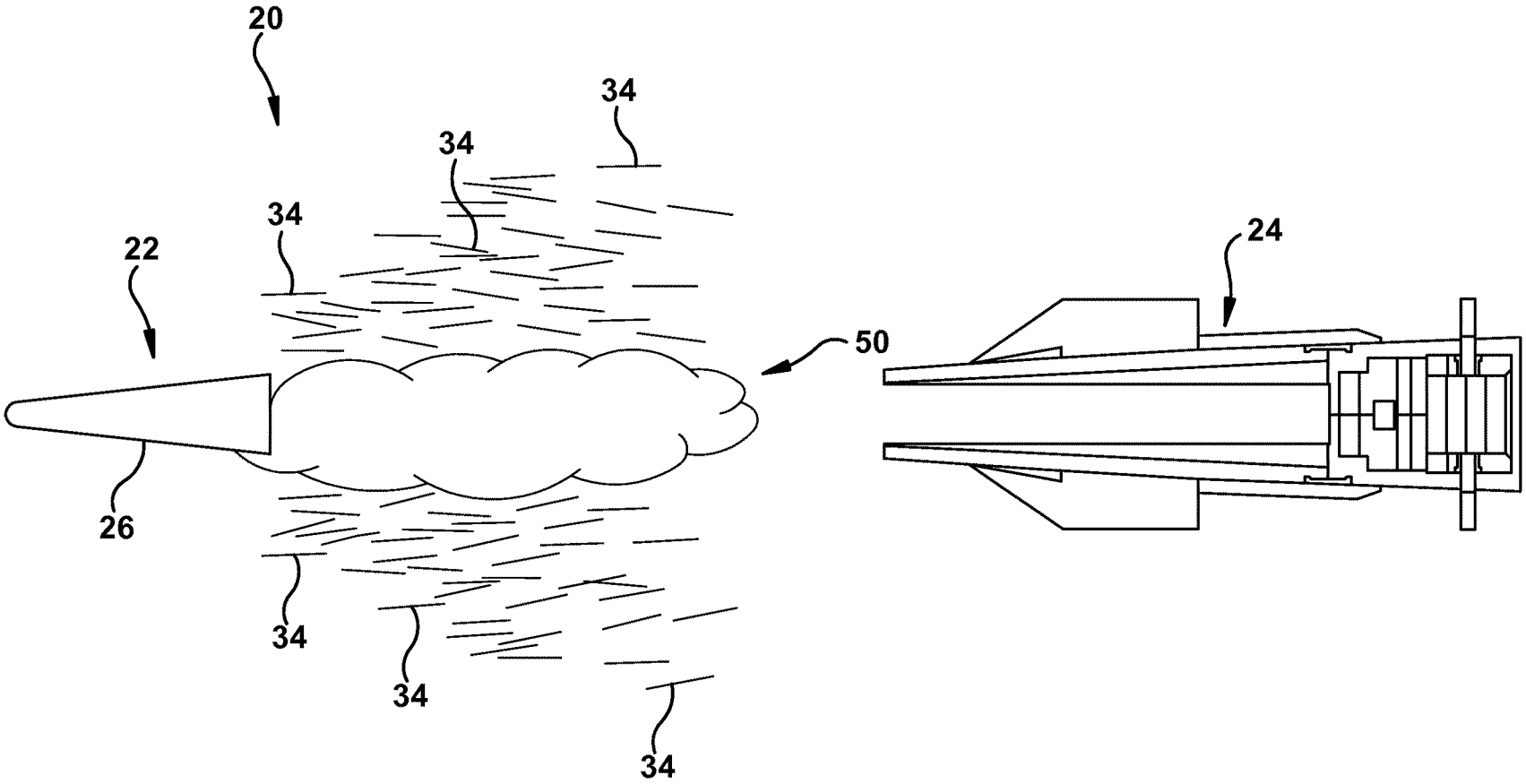

The illustrated projectile 20 includes both a shaped ring-cutting first explosive charge 40 arranged to break a coupling 44 between the leading section 22 and the trailing section 24, and a central longitudinally-extending dispersing second explosive charge 50 around which the flechettes 34 are arrayed. The controller 54 is configured to initiate the shaped first explosive charge 40 to uncouple the leading section 22 from the trailing section 24. The controller 54 also is configured to control the attitude of the control surfaces 52, in this case aerodynamic control fins, to the braking attitude to retard forward motion of the trailing section 24, and thereby use aerodynamic forces to separate the leading section 22 from the trailing section 24. After the leading section 22 and the trailing section 24 have been uncoupled, whether from the first explosive charge 40 or through other means, mechanisms, or agents (FIG. 3), the controller 54 directs the control surfaces 52 to assume a braking attitude and apply a braking force to the trailing section 24 (FIG. 4). The trailing section 24 may be lighter than the leading section 22. Continued forward momentum of the leading section 22 in the forward direction 30 and the application of an aerodynamic braking force on the trailing section 24 in a direction opposite the forward direction will cause the leading section 22 to telescopically extend from and potentially completely separate from the trailing section 24 (FIG. 4). After a delay to achieve sufficient separation to remove the outer trailing section 24 from around the flechettes 34, the controller 54 initiates the dispersing second explosive charge 50 to outwardly disperse the flechettes 34 (FIG. 5). Optionally, the controller 54 also may be configured to move the control surfaces 52 to the spin attitude to generate spin in the projectile 20 before the dispersing second explosive charge 50 acts, the spin generating centrifugal force to assist in dispersing the flechettes 34. Alternatively, the controller 54 may initiate the dispersing second explosive charge 50 at the same time as or shortly after initiating the first explosive charge 40. In this situation, either the controller 54 or the second explosive charge 50 has a delay mechanism to delay the release of explosive energy until after the leading section 22 and the trailing section 24 separate, and optionally until after the control surfaces 52 have generated a desired rate of spin in the projectile 20.

Accordingly, the present invention also provides a method of deploying a flechette weapon system having such a leading section 22 and a trailing section 24. The method includes the following steps: (a) uncoupling the leading section 22 from the trailing section 24, (b) separating the leading section 22 from the trailing section 24 after the uncoupling step; and (c) dispersing multiple flechettes 34 from the leading section 22 radially outwardly after the separating step.

The separating step may include deploying control surfaces 52 to apply an aerodynamic braking force to the trailing section 24, as described above.

The dispersing step may occur after a predetermined delay following the separating step to allow complete separation of the leading section 22 from the trailing section 24 before dispersing the flechettes 34. The dispersing step also may include spinning the projectile 20 or the leading section 22 about the longitudinal axis 42 or other axis to help outwardly disperse the flechettes 34.

The present invention further provides a projectile 20 that includes a housing having a leading section 22 at a leading end 28 telescopically extending into a trailing section 24 at a trailing end 56 opposite the leading end 28, with the leading section 22 and the trailing section 24 being held together by a coupling 44. The projectile 20 further includes a first explosive charge 40 that includes a shaped explosive ring-cutting charge arranged to break the coupling 44 upon initiation, thereby decoupling the leading section 22 from the trailing section 24. The leading section 22 has a plurality of flechettes 34 surrounding a second explosive charge 50 that includes a central, longitudinally-extending, pyro-burster second explosive charge 50. The illustrated second explosive charge 50 tapers toward the leading end 28 of the projectile 20. The projectile 20 further includes a plurality of aerodynamic control fins 52 extending from an outer surface 32 of the projectile 20 that are movable to a braking attitude that causes an aerodynamic braking force to be applied to the trailing section 24 during flight. The control fins 52 also may be movable to a spin attitude to cause the projectile 20 to spin about its longitudinal axis 42. And finally, the projectile 20 includes a controller 54 that (a) initiates the first explosive charge 40 to release the trailing section 24 from the leading section 22, (b) controls the movement of the control fins 52 to the braking attitude to separate the trailing section 24 from the leading section 22 (and optionally to the spin attitude to generate spin in the projectile 20), and (c) initiates the second explosive charge 50 to disperse the flechettes 34 from the leading section 22 after a predetermined delay to allow the leading section 22 to separate from the trailing section 24, and optionally also to allow the projectile to increase its spin to a desired speed.

Thus, the invention described here uses aerodynamic force to assist in removing the flechettes 34 from a confining structure of a projectile 20 before dispersing them. In this manner, because energy is extracted from the fluid flow passing the projectile 20, the amount of energetic material required is significantly reduced. A small amount of energetic material, such as a small cutting explosive charge 40, or other means may be used to release an outer portion (trailing section 24) of the projectile body in such a way that aerodynamic forces expose the flechettes 34, and a small burster explosive charge 50 is used to disperse the flechettes 34 once they are removed from the outer projectile body. Using this approach, low-energy energetic materials can be used and efficiently employed so that only small amounts are necessary.

In summary, the present invention provides a projectile 20 having a leading section 22 and a trailing section 24 coupled together to define a structure containing a plurality of flechettes 34. The trailing section 24 includes aerodynamic control surfaces 52 that are deployable to apply an aerodynamic braking force to the trailing section 24 during flight to separate the trailing section 24 from the leading section 22. The flechettes 34 surround an explosive charge 50 in the leading section 22 such that, after the leading section 22 and the trailing section 24 have separated, initiation of the explosive charge 50 outwardly disperses the flechettes 34. The control surfaces 52 optionally also may impart spin to the projectile 20 to assist in dispersing the flechettes 34. Thus, aerodynamic force is employed to assist in removing the flechettes 34 from their confining structure in the projectile 20 before dispersing them.

Although the invention has been shown and described with respect to a certain preferred embodiment, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention.

The invention claimed is:

1. A projectile, comprising:

a housing having a leading section having a plurality of flechettes surrounding an explosive charge arranged to outwardly disperse the flechettes, and a trailing section coupled to the leading section;

a plurality of aerodynamic control surfaces deployable from an outer surface of the trailing section of the housing;

a controller configured to control the aerodynamic control surfaces to apply an aerodynamic braking force to the trailing section to separate the trailing section from the leading section; and a decoupler adapted to release the leading section from the trailing section, where the decoupler includes a first explosive charge, and the explosive charge surrounded by the flechettes is a second explosive charge.

2. A projectile as set forth in claim 1, comprising a coupling that holds the leading section and the trailing section together.

3. A projectile as set forth in claim 1, where the first explosive charge includes one of a shaped charge and a ring cutting charge.

4. A projectile as set forth in claim 1, where the explosive charge is a longitudinally-extending pyro burster explosive charge.

5. A projectile as set forth in claim 1, where the explosive charge extends parallel to a longitudinal axis of the projectile and tapers toward a leading end.

6. A projectile as set forth in claim 1, where the control surfaces include control fins having a controllable attitude to control the flight of the projectile.

7. A projectile as set forth in claim 1, where the control surfaces include a control fin rotatable to a braking orientation.

8. A projectile as set forth in claim 1, where the control surfaces extend perpendicular to the outer surface of the trailing section.

9. A projectile as set forth in claim 1, where the control surfaces include a plurality of control surfaces circumferentially arranged around the trailing section.

10. A projectile as set forth in claim 1, where the flechettes are circumferentially arrayed around and parallel to a longitudinal axis of the projectile.

11. A projectile as set forth in claim 1, where the controller is adapted to control both the control surfaces and the explosive charge.

12. A projectile as set forth in claim 11, further comprising a shaped explosive charge arranged to break a coupling between the leading section and the trailing section;

where the explosive charge around which the flechettes are arrayed includes a central longitudinally-extending dispersing explosive charge; and;

where the controller is configured (a) to initiate the shaped explosive charge to uncouple the leading section from the trailing section, (b) to control the attitude of the control surfaces to the braking attitude to retard forward motion of the trailing section and thereby use aerodynamic forces to separate the leading section from the trailing section, and then (c) to initiate the dispersing explosive charge to outwardly disperse the flechettes.

13. A projectile as set forth in claim 12, where the controller is configured to control the attitude of the control surfaces to a spin attitude to generate spin about a longitudinal axis of the projectile to assist in dispersing the flechettes.

14. A projectile as set forth in claim 1, where the leading section is telescopically received in the trailing section.

15. A method of deploying a flechette weapon system having a leading section and a trailing section, the method comprising the following steps:

uncoupling the leading section from the trailing section;

separating the leading section from the trailing section after the uncoupling step; and dispersing multiple flechettes from the leading section radially outwardly after the separating step;

where the separating step includes deploying control surfaces to apply an aerodynamic braking force to the trailing section.

16. A method as set forth in claim 15, where the dispersing step occurs after a predetermined delay following the separating step to allow complete separation of the leading section from the trailing section before dispersing the flechettes.

17. A method as set forth in claim 15, where the uncoupling step includes initiating an explosive charge.

18. A method as set forth in claim 15, where the dispersing step includes spinning the projectile about a longitudinal axis to assist in dispersing the flechettes.

19. A projectile, comprising:

a housing having a leading section at a leading end telescopically extending into a trailing section at a trailing end, the leading section and the trailing section being held together by a coupling;

a first explosive charge that includes a shaped explosive ring-cutting charge arranged to break the coupling upon initiation, thereby decoupling the leading section from the trailing section;

where the leading section has a plurality of flechettes surrounding a second explosive charge that includes a central longitudinally-extending pyro-burster explosive charge, the second explosive charge tapering toward the leading end of the housing;

a plurality of aerodynamic control fins extending from an outer surface of the housing that are movable to a braking attitude that causes an aerodynamic braking force to be applied to the trailing section during flight;

a controller that initiates the first explosive charge to release the trailing section from the leading section, controls the movement of the control fins to the braking attitude to separate the trailing section from the leading section, and initiates the second explosive charge to disperse the flechettes from the leading section after a predetermined delay to allow the leading section to separate from the trailing section.

* * * * *